US010317128B2

(12) United States Patent
Son et al.

(10) Patent No.: US 10,317,128 B2
(45) Date of Patent: Jun. 11, 2019

(54) REFRIGERATOR

(71) Applicant: SAMSUNG ELECTRONICS CO., LTD., Suwon-si, Gyeonggi-do (KR)

(72) Inventors: Su Hyeong Son, Incheon (KR); Yang-Yeol Gu, Gwangju (KR); Hyung Bum Lee, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/861,223

(22) Filed: Jan. 3, 2018

(65) Prior Publication Data

US 2018/0187955 A1 Jul. 5, 2018

Related U.S. Application Data

(60) Provisional application No. 62/441,801, filed on Jan. 3, 2017.

(30) Foreign Application Priority Data

Jun. 23, 2017 (KR) ..... 10-2017-0079716

(51) Int. Cl.
*E05D 11/00* (2006.01)
*E05D 11/10* (2006.01)
(Continued)

(52) U.S. Cl.
CPC ..... *F25D 23/028* (2013.01); *E05D 7/081* (2013.01); *E05D 11/105* (2013.01);
(Continued)

(58) Field of Classification Search
CPC ..... F25D 23/028; F25D 2323/02; F25D 2323/024; E05D 7/081; E05Y 2900/31
See application file for complete search history.

(56) References Cited

U.S. PATENT DOCUMENTS

2010/0125970 A1* 5/2010 Leimkuehler ..... E05D 11/0054 16/251
2010/0231110 A1* 9/2010 Choi ..... E05D 5/02 312/405

(Continued)

FOREIGN PATENT DOCUMENTS

KR 1999-0037698 10/1999
KR 1999-0040764 12/1999
KR 10-2012-0013830 2/2012

*Primary Examiner* — Daniel J Rohrhoff
(74) *Attorney, Agent, or Firm* — Staas & Halsey LLP

(57) ABSTRACT

A refrigerator includes a main body having a storage compartment; a first door rotatably provided to open and close the storage compartment; a hinge member coupled to a lower portion of the first door and configured to support the first door to allow the first door to be rotatable; a second door provided below the hinge member, wherein the second door includes a door body and a door trim protruding from the door body toward the hinge member, the hinge member includes a main body coupler and a door supporter, and a bottom surface of the door supporter includes a base surface and a recessed surface. The recessed surface is recessed from the base surface to compensate for a height difference between an upper surface of the door trim and an upper surface of the door body.

18 Claims, 15 Drawing Sheets

(51) Int. Cl.
*E05D 7/081* (2006.01)
*F25D 23/02* (2006.01)

(52) U.S. Cl.
CPC ..... *E05D 11/1014* (2013.01); *E05D 11/00* (2013.01); *E05Y 2900/31* (2013.01); *F25D 2323/021* (2013.01); *F25D 2323/024* (2013.01); *F25D 2400/36* (2013.01)

(56) References Cited

U.S. PATENT DOCUMENTS

2013/0154464 A1* 6/2013 Fiori ..... E05D 7/0423 312/405
2014/0132141 A1* 5/2014 Sun ..... E05D 7/0027 312/404
2014/0232250 A1* 8/2014 Kim ..... F25D 23/028 312/292
2015/0368944 A1* 12/2015 Yi ..... B21D 53/40 312/405
2016/0061511 A1* 3/2016 Park ..... F25D 11/02 312/404
2016/0209110 A1* 7/2016 Cho ..... F25D 23/062
2016/0252291 A1* 9/2016 Kikuchi ..... F25D 23/028 312/405
2016/0334159 A1 11/2016 Hong et al.
2016/0356542 A1* 12/2016 Kim ..... E05D 7/081
2016/0363392 A1 12/2016 Winterstten et al.
2017/0167173 A1* 6/2017 Johnson ..... E05D 11/0081
2018/0187951 A1* 7/2018 Seo ..... F25D 23/02
2018/0209190 A1* 7/2018 Zhang ..... E05D 3/02

* cited by examiner

REFRIGERATOR

This application claims the benefit of U.S. Provisional Patent Application No. 62/441,801, filed on Jan. 3, 2017 in the United States Patent & Trademark Office, and Korean Patent Application No. 10-2017-0079716, filed on Jun. 23, 2017 in the Korean Intellectual Property Office, the disclosure of which is incorporated herein by reference.

BACKGROUND

1. Field

Embodiments of the present disclosure relate to a hinge member of a door of a refrigerator.

2. Description of the Related Art

A refrigerator is a home appliance configured to freshly store foods by providing a main body having a storage compartment, a cold air supply device configured to supply cold air to the storage compartment, and a door provided to open and close the storage compartment.

A plurality of storage compartments which are divided from each other in a vertical direction may be provided at the main body, and a plurality of doors may be provided to open and close the storage compartments, respectively. Generally, in a bottom mounted freezer (BMF) type or a French door type refrigerator (FDR) in which a refrigerating compartment is formed at an upper portion and a freezing compartment is formed at a lower portion, a door of the refrigerating compartment is rotatably provided by an upper hinge member and an intermediate hinge member, and a door of the freezing compartments slidably provided in a form of a drawer by a sliding device.

The intermediate hinge member is coupled to a lower portion of the door of the refrigerating compartment to support a weight of the refrigerator, and includes a hinge pin forming a rotational axis of the door of the refrigerating compartment. The intermediate hinge member includes a main body coupler provided substantially parallel to a front surface of the main body to be coupled thereto, and a door supporter protruding perpendicular to the main body coupler to support the door. The hinge pin may be provided to protrude upward from the door supporter, and may be inserted into a hinge recess formed at a lower portion of the door of the refrigerating compartment.

A predetermined gap may be formed between the intermediate hinge member and the door of the freezing compartment. This is to prevent interference between the intermediate hinge member and the door of the freezing compartment due to sagging phenomena of the door of the refrigerating compartment and the intermediate hinge member, and to improve an overall exterior appearance of the refrigerator.

However, when a portion of the freezing compartment protrudes toward the intermediate hinge member, the gap between the intermediate hinge member and the door of the freezing compartment becomes relatively narrow at the protruding portion.

SUMMARY

It is one objective of the present disclosure to provide an intermediate hinge having an improved shape in which a gap between a bottom surface of the intermediate hinge and an upper surface of the door is kept constant in an entire area of the bottom surface of the intermediate hinge when a height of the upper surface of the door disposed below the intermediate hinge is not constant and there is a protruding portion, and a refrigerator having the intermediate hinge.

Further, it is another objective of the present disclosure to provide a door having an improved shape which minimizes exposure of a hinge assembly configured to support the door of a refrigerator, and a refrigerator having the door.

Additional aspects of the disclosure will be set forth in part in the description which follows and, in part, will be obvious from the description, or may be learned by practice of the disclosure.

According to one aspect of the present disclosure, there is provided a refrigerator including a main body having a storage compartment; a first door rotatably provided to open and close the storage compartment; a hinge member coupled to a lower portion of the first door and configured to support the first door to allow the first door to be rotatable; a second door provided below the hinge member, wherein the second door includes a door body and a door trim protruding from the door body toward the hinge member, the hinge member includes a main body coupler provided to be coupled to the main body and a door supporter extending from the main body coupler in a direction intersecting therewith, and a bottom surface of the door supporter includes a base surface and a recessed surface recessed from the base surface to compensate for a height difference between an upper surface of the door trim and an upper surface of the door body.

The bottom surface of the door supporter may include a connecting surface configured to connect the base surface to the recessed surface and formed in a vertical direction.

The connecting surface may extend in a front-rear direction of the refrigerator.

A height difference between the base surface and the recessed surface may be equal to the height difference between the upper surface of the door trim and the upper surface of the door body.

The height difference between the base surface and the recessed surface may be less than half a thickness of the door supporter.

The recessed surface may be disposed further than the base surface at a side opposite to a central portion of the refrigerator.

Each of the base surface and the recessed surface may be formed to be flat.

Each of the base surface and the recessed surface may be formed to be parallel to an upper surface of the door supporter.

The main body coupler and the door supporter may be integrally formed of metal materials.

The door body may include an upper cap having a handle recess, and the door trim may be coupled to an upper portion of the upper cap.

The door trim may include a gripper configured to allow a user to hold and open the second door, and the gripper may be inserted into the handle recess.

The door trim may extend from a left end to a right end of the second door.

The door body may include an upper plate having a display installation recess therein at which a display is installed, and the door trim may be coupled to an upper portion of the upper plate.

According to another aspect of the present disclosure, there is provided a refrigerator including a main body having a storage compartment; a door rotatably provided to open and close the storage compartment; and a hinge assembly coupled to a lower portion of the door and configured to support the door to allow the door to be rotatable, wherein the door includes a lower cap, the lower cap includes a bottom portion configured to form a bottom surface of the door, and a hinge installation portion provided to allow the hinge assembly to be coupled, and the hinge installation portion is formed to be recessed from the bottom portion so as to prevent exposure of at least a portion of the hinge assembly.

The hinge assembly may include a hinge member having a hinge pin configured to form a rotational axis of the door and coupled to the main body, and a hinge bracket having a through-hole through which the hinge pin passes and coupled to a lower portion of the door, and the hinge installation portion may include a base stepped portion, and a hinge bracket installation portion formed to be recessed from the base stepped portion to allow the hinge bracket to be installed.

The hinge assembly may include an elastic member provided to apply a force to the door in a direction in which the door is closed, and the hinge installation portion may include an elastic member installation portion formed to be recessed from the base stepped portion to allow the elastic member to be installed.

At least a portion of the hinge assembly may not be exposed when the refrigerator is viewed from the front thereof.

At least a portion of the bottom portion may be disposed at a front side of the hinge installation portion.

Each of the hinge member and the hinge bracket may be formed of a metal material, and the hinge assembly may include a grommet member made of a resin material and provided between the hinge member and the hinge bracket to prevent rubbing therebetween.

BRIEF DESCRIPTION OF THE DRAWINGS

These and/or other aspects of the disclosure will become apparent and more readily appreciated from the following description of the embodiments, taken in conjunction with the accompanying drawings, of which.

DETAILED DESCRIPTION

Embodiments described herein and configurations shown in the accompanying drawings are merely preferred examples of the present disclosure and do not represent all technical spirits of the present disclosure, and thus it should be understood that various equivalents or modified examples which may replace the embodiments and the accompanying drawings of the present disclosure fall within the appended claims at the time at which the present application is filed.

Hereinafter, preferred embodiments of the present disclosure will be described in detail with reference to the accompanying drawings.

Figure 1:
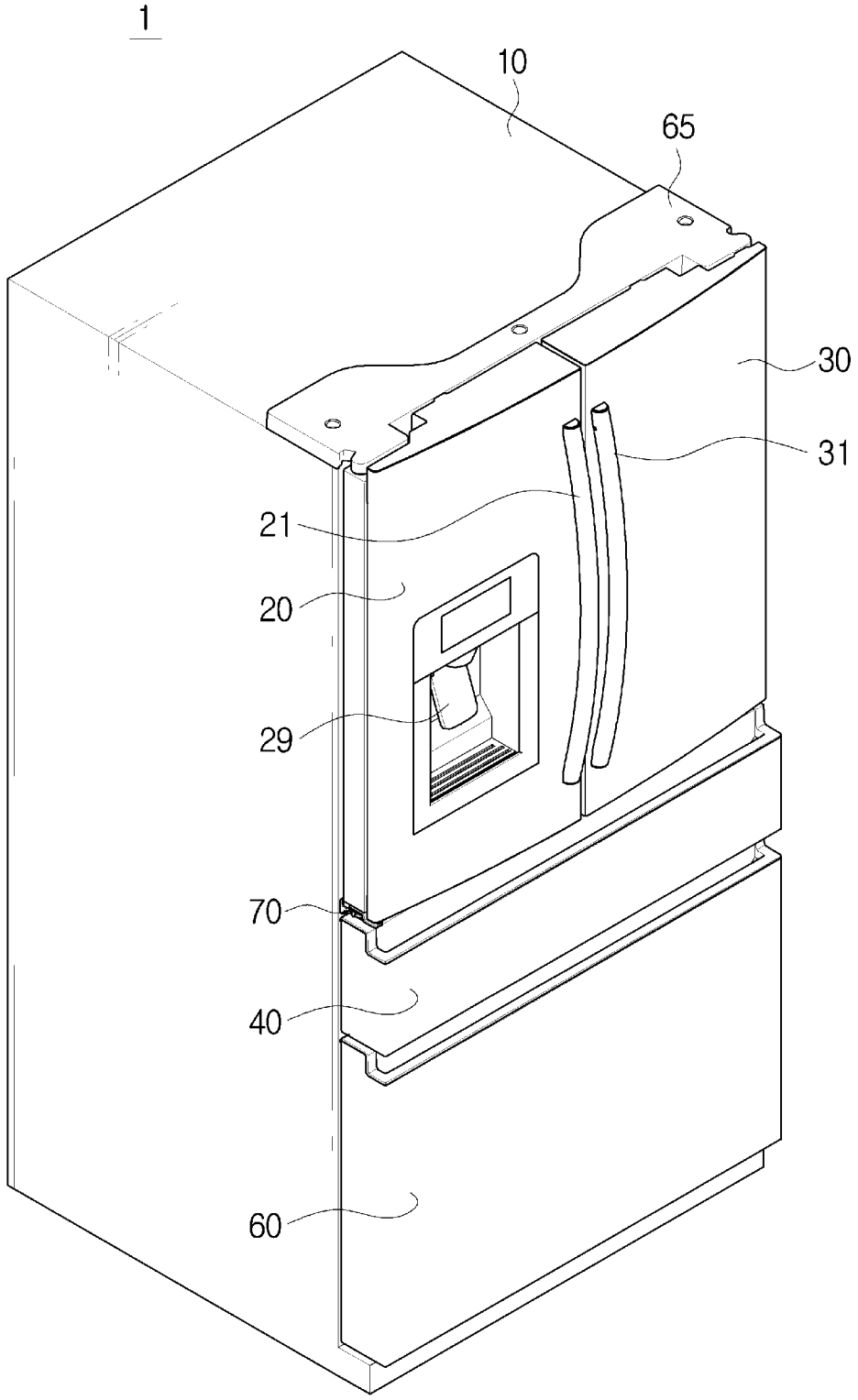
FIG. 1 is a perspective view illustrating an exterior appearance of a refrigerator according to one embodiment of the present disclosure.
Figure 2:
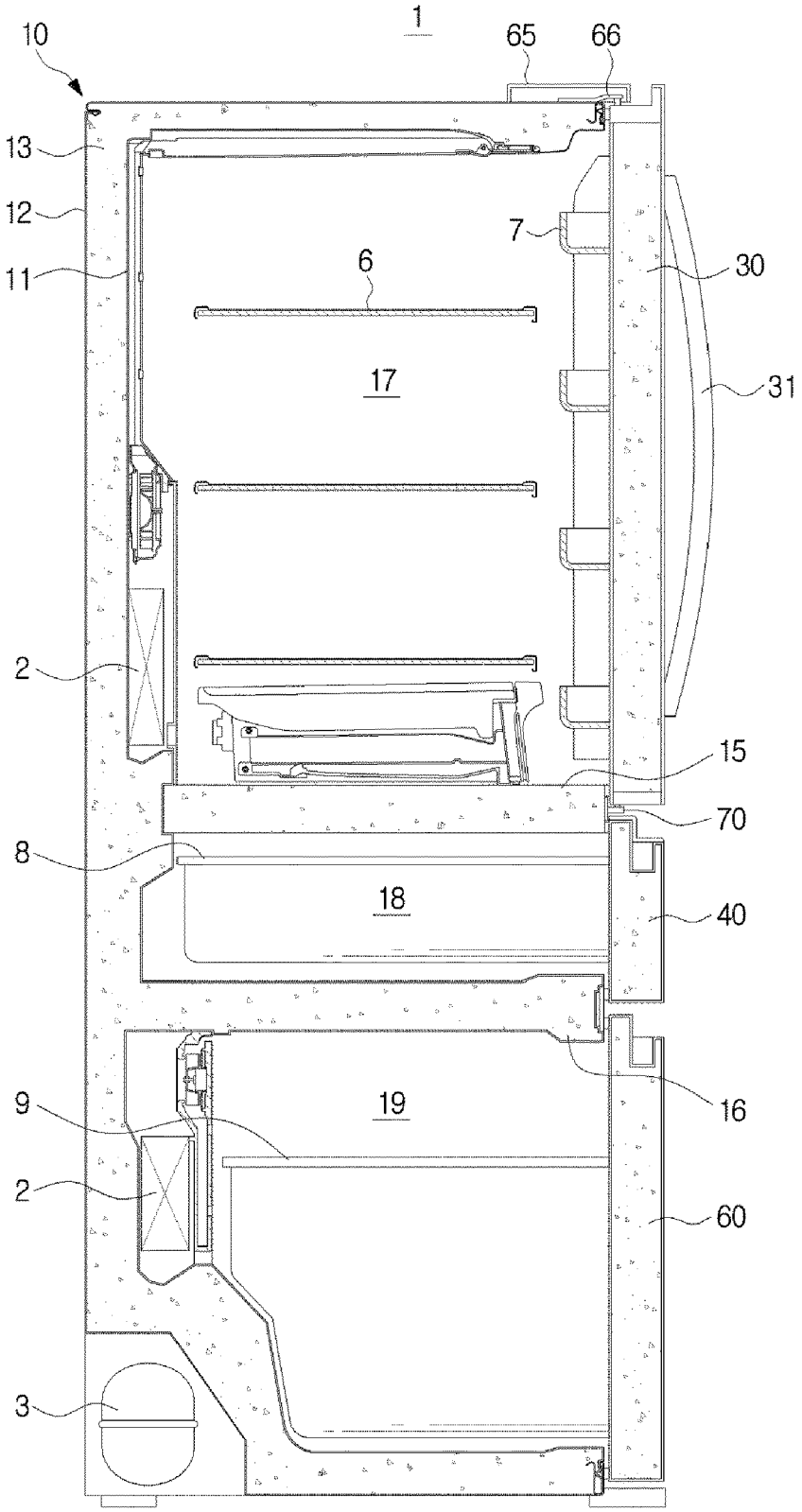
FIG. 2 is a side cross-sectional view illustrating a schematic configuration of the refrigerator according to one embodiment of the present disclosure.

FIG. 1 is a perspective view illustrating an exterior appearance of a refrigerator according to one embodiment of the present disclosure. FIG. 2 is a side cross-sectional view illustrating a schematic configuration of the refrigerator according to one embodiment of the present disclosure.

Referring to FIGS. 1 and 2, a refrigerator 1 may include a main body 10 having storage compartments 17, 18, and 19; doors 20, 30, 40, and 60 provided at a front side of the storage compartments 17, 18, and 19, respectively, and configured to open and close the storage compartments 17, 18, and 19; and a cold air supply device configured to supply cold air to the storage compartments 17, 18, and 19.

The cold air supply device may include an evaporator 2, a compressor 3, a condenser (not shown), an expansion device (not shown), and a blowing fan, and may generate cold air using evaporative latent heat of a refrigerant.

The main body 10 may include an inner case 11 configured to form the storage compartments 17, 18, and 19; an outer case 12 coupled to the outside of the inner case 11 and configured to form an exterior appearance of the refrigerator 1; and an insulation 13 provided between the inner case 11 and the outer case 12 and configured to insulate the storage compartments 17, 18, and 19. The inner case 11 may be formed of a plastic material, and the outer case 12 may be formed of a metal material. A urethane foam insulation or a vacuum insulation panel (VIP) may be used as the insulation 13.

Meanwhile, the main body 10 may include intermediate walls 15 and 16, and the storage compartments 17, 18, and 19 may be comparted into an upper storage compartment 17, an intermediate storage compartment 18, and a lower storage compartment 19 by the intermediate walls 15 and 16. Alternatively, unlike the present embodiment, only one intermediate wall may be provided, and an upper storage compartment and a lower storage compartment may be provided only without an intermediate storage compartment.

The upper storage compartment 17 may be maintained at about 0 to 5 degrees Celsius to be used as a refrigerating compartment keeping foods in a refrigerated state, the lower storage compartment 19 may be maintained at about minus 30 to 0 degrees Celsius to be used as a freezing compartment keeping food in a frozen state, and the intermediate storage compartment 18 may be used as a temperature-variable compartment in which a temperature is varied. However, the use of each of the storage compartment 17, 18, and 19 is not particularly limited.

Each of the storage compartments 17, 18, and 19 may be provided to have an open front surface allowing foods to be taken in and out, the open front surfaces of the storage compartments 17, 18, and 19 may be opened or closed by the doors 20, 30, 40, and 60, respectively. The upper storage compartment 17 may be opened and closed by the pair of doors 20 and 30 provided to be rotatable in mutually opposite directions, and the intermediate storage compartment 18 and the lower storage compartment 19 may be opened and closed by the intermediate door 40 and the lower door 60, respectively, wherein each of the intermediate door 40 and the lower door 60 are slidably provided in a drawer manner. Alternatively, unlike the present embodiment, the intermediate storage compartment 18 and the lower storage compartment 19 may also be opened or closed by doors in a rotary manner instead of the drawer manner.

A shelf 6 on which foods are placed may be provided inside the upper storage compartment 17. The upper doors 20 and 30 may be provided at left and right sides of the upper storage compartment 17, respectively. An upper hinge 66 may be coupled to an upper portion of each of the upper doors 20 and 30, and an intermediate hinge assembly 70 may be coupled to a lower portion of each of the upper doors 20 and 30. The upper hinge 66 and the intermediate hinge assembly 70 may rotatably support each of the upper doors 20 and 30.

The intermediate hinge assembly 70 is coupled to the lower portion of each of the upper doors 20 and 30 to substantially support a weight of each of the upper doors 20 and 30. The intermediate hinge assembly 70 may be disposed between the upper doors 20 and 30 and the intermediate door 40.

A door guard 7 capable of storing foods may be provided on a rear surface of each of the upper doors 20 and 30, handles 21 and 31 which are held by a hand to open and close the upper doors 20 and 30 may be provided at a front surface of each of the upper doors 20 and 30. A dispenser 29 capable of supplying water or ice in a state in which the upper door 20 is closed may be provided at the upper door 20. A hinge cover 65 may be coupled to an upper portion of the main body 10 to cover the upper hinge 66 so as to prevent exposure of the upper hinge 66.

Baskets 8 and 9 capable of storing foods may be provided at rear surfaces of the intermediate door 40 and the lower door 60, respectively. The baskets 8 and 9 may be pulled in and out of the storage compartments 18 and 19 together with the doors 40 and 60 when the doors 40 and 60 are pulled in and out.

Figure 3:
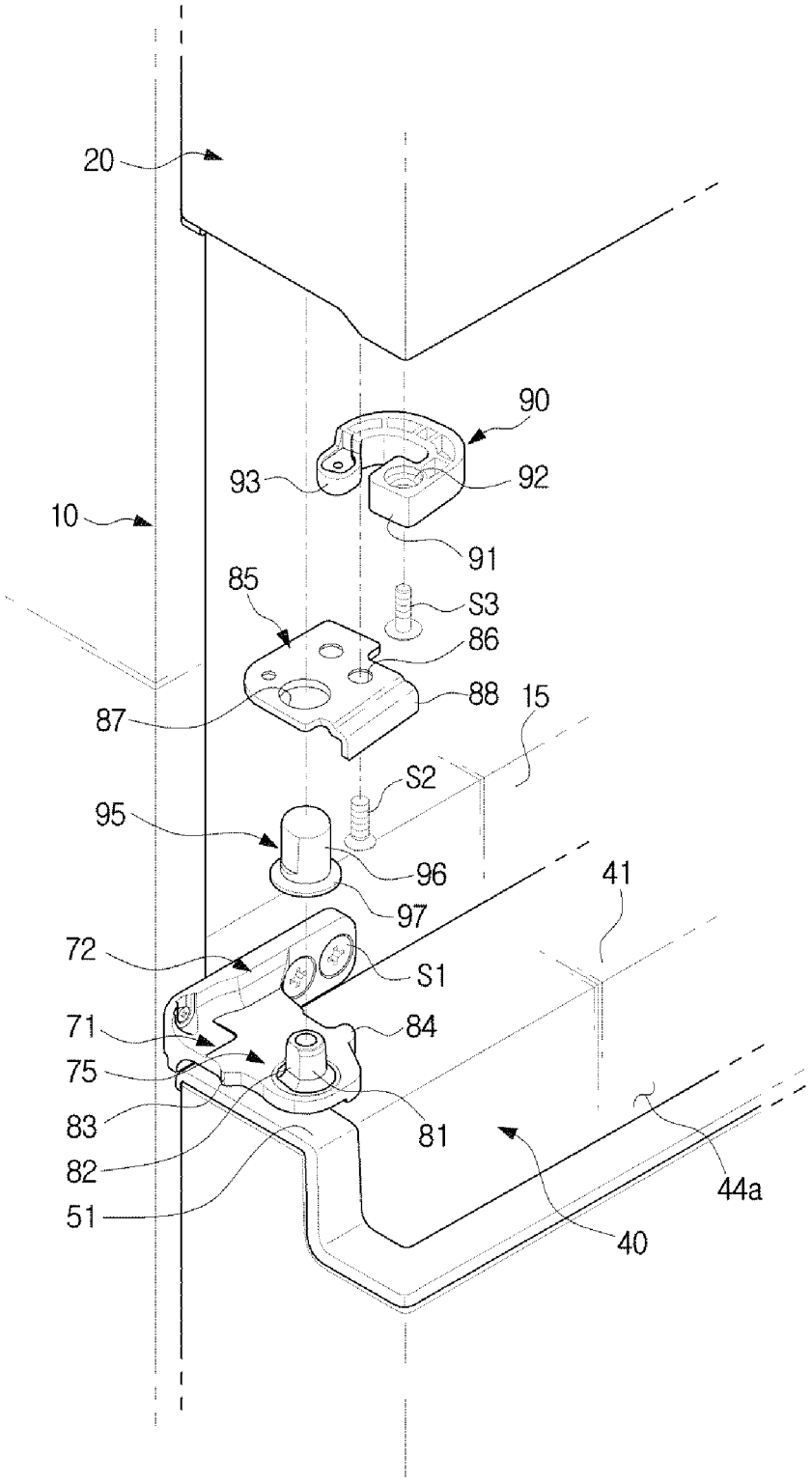
FIG. 3 is an exploded perspective view illustrating an intermediate hinge assembly of the refrigerator according to one embodiment of the present disclosure.
Figure 4:
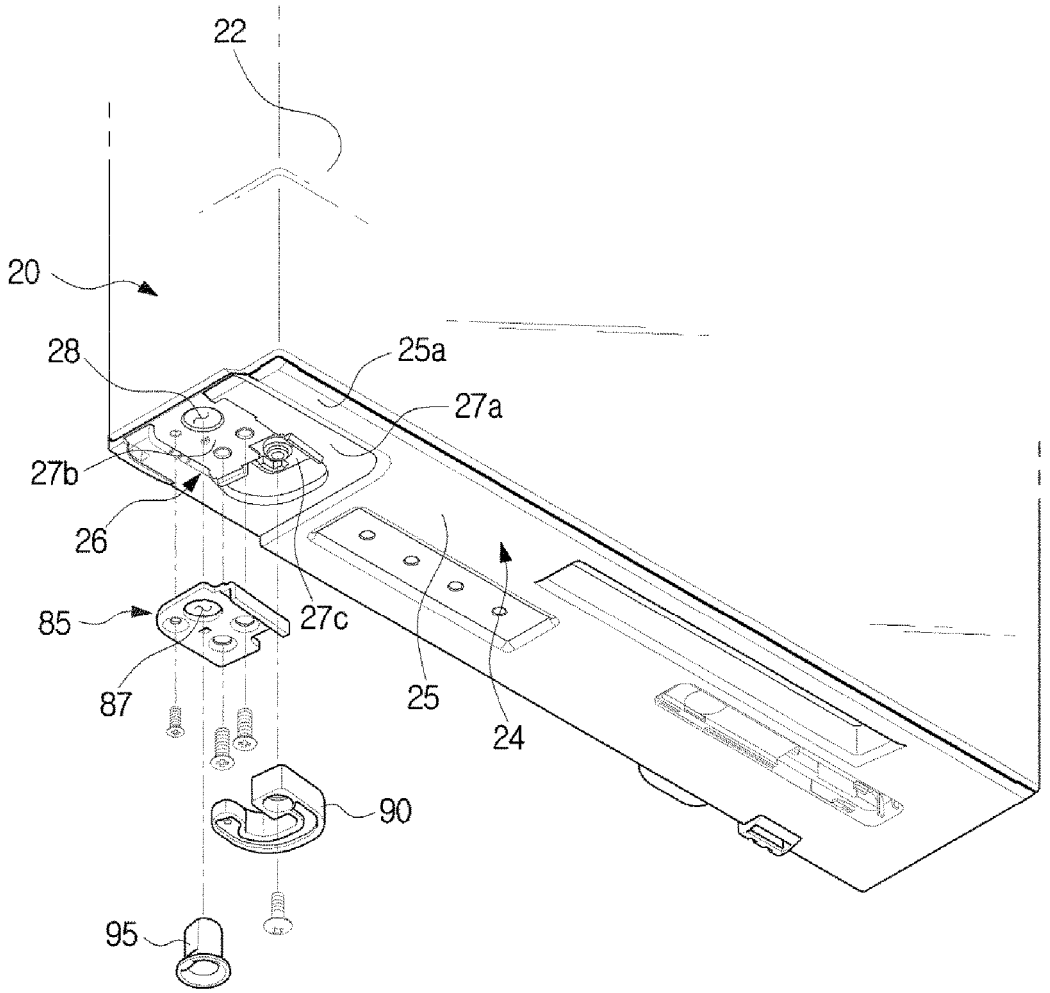
FIG. 4 is an exploded perspective view illustrating a structure in which the intermediate hinge assembly of the refrigerator according to one embodiment of the present disclosure is coupled to a bottom surface of an upper door.
Figure 5:
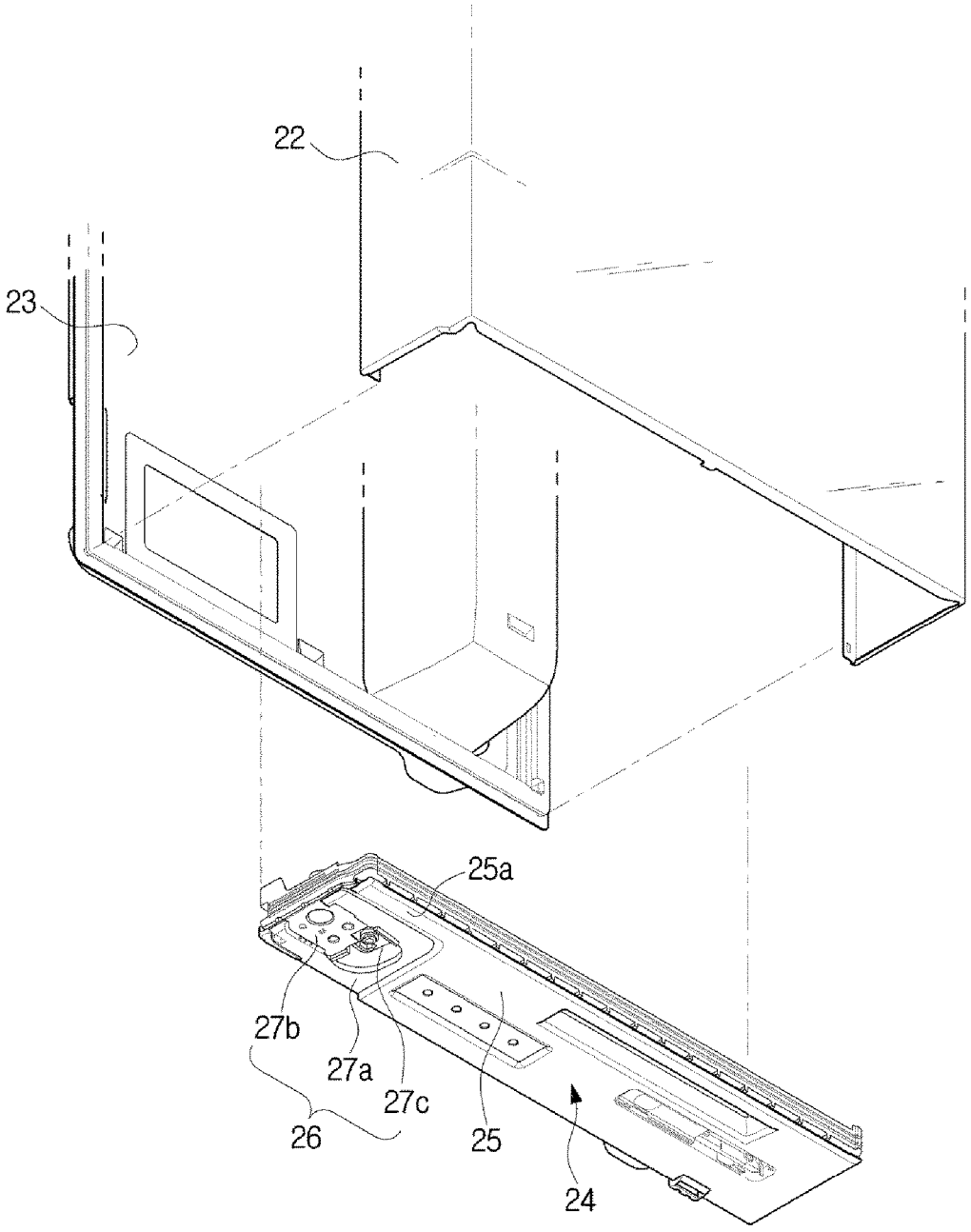
FIG. 5 is an exploded perspective view of the upper door of the refrigerator according to one embodiment of the present disclosure.
Figure 6:
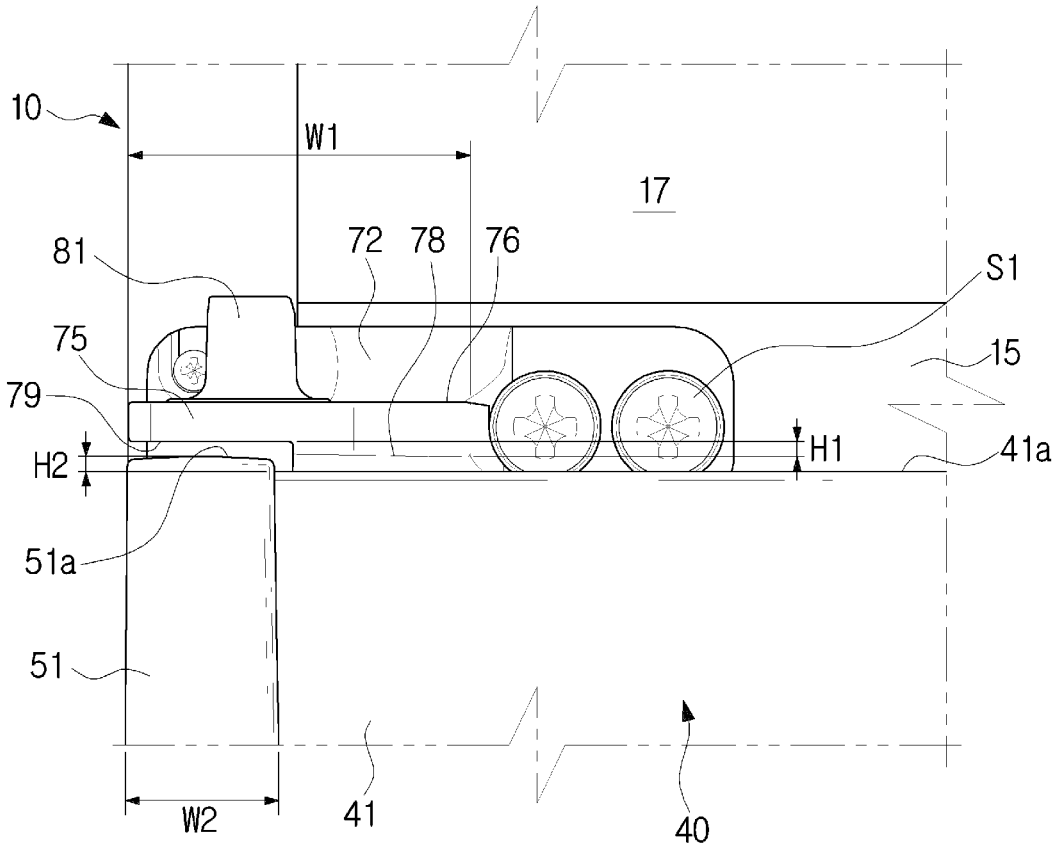
FIG. 6 is a front view illustrating a state in which a hinge member of the refrigerator according to one embodiment of the present disclosure is installed at a main body (the upper door is not shown)
Figure 7:
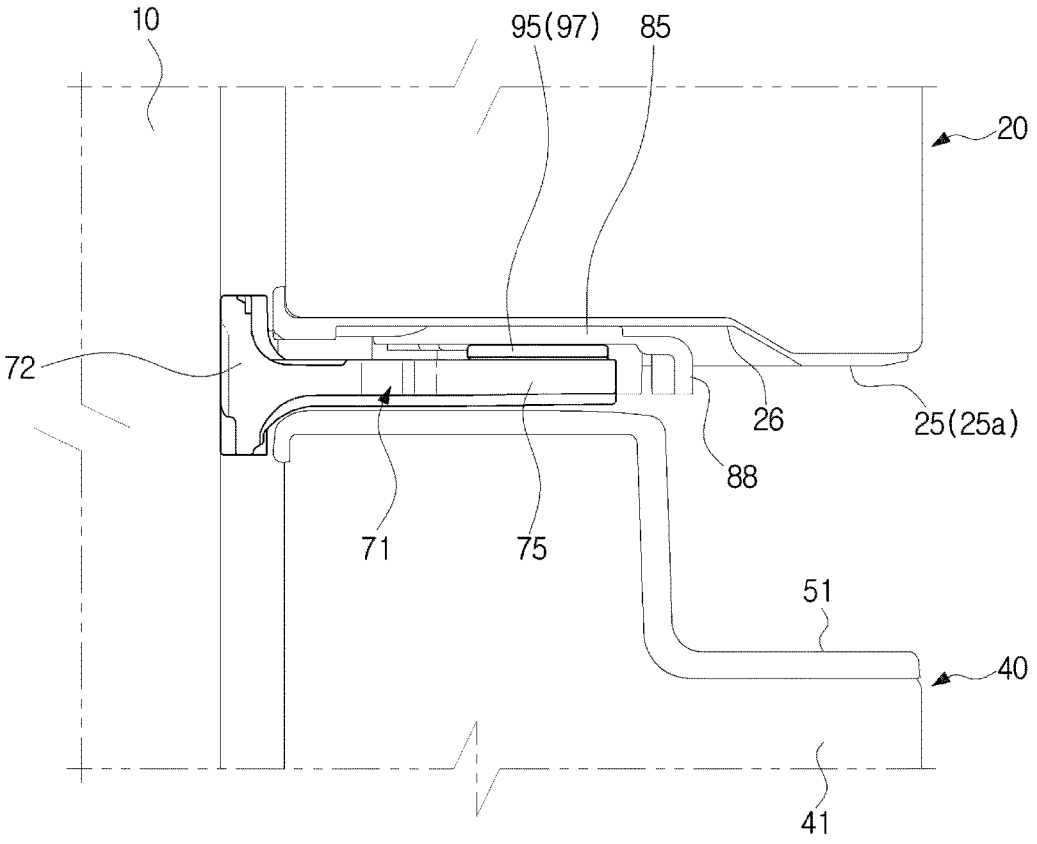
FIG. 7 is a side view of a vicinity of the intermediate hinge assembly of the refrigerator according to one embodiment of the present disclosure.
Figure 8:
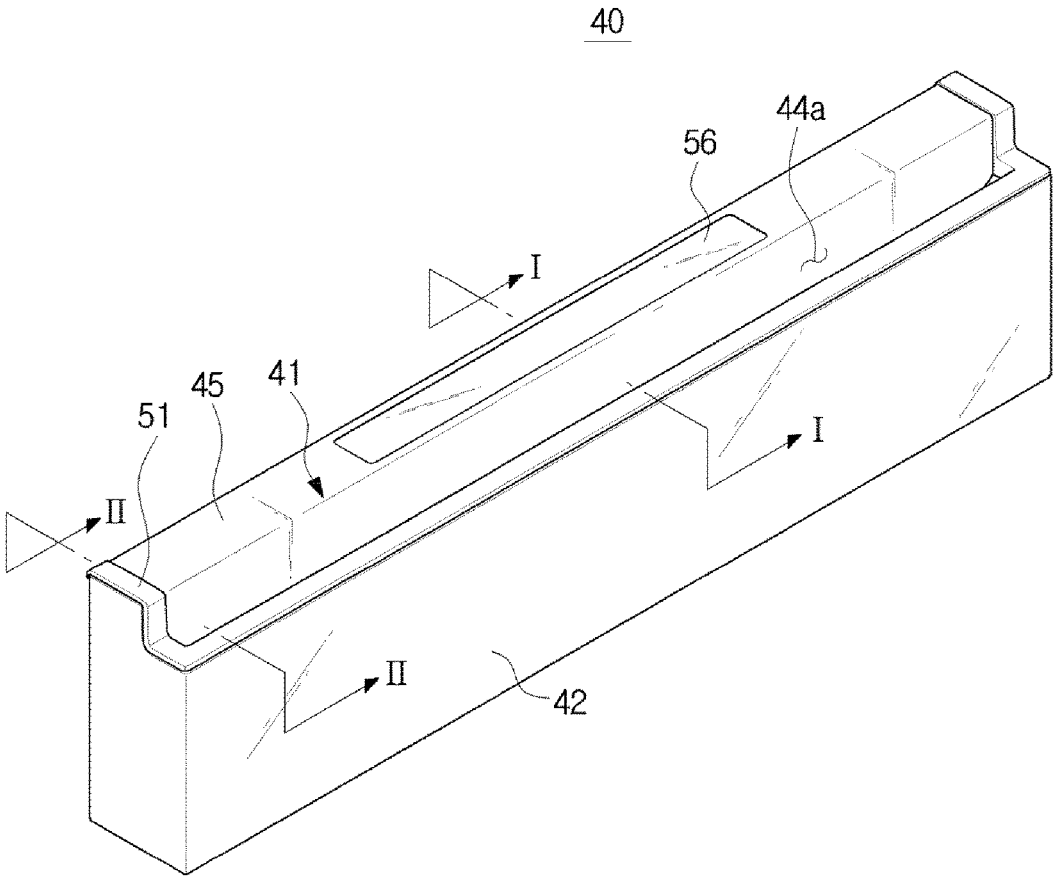
FIG. 8 is a perspective view of an intermediate door of the refrigerator according to one embodiment of the present disclosure.
Figure 9:
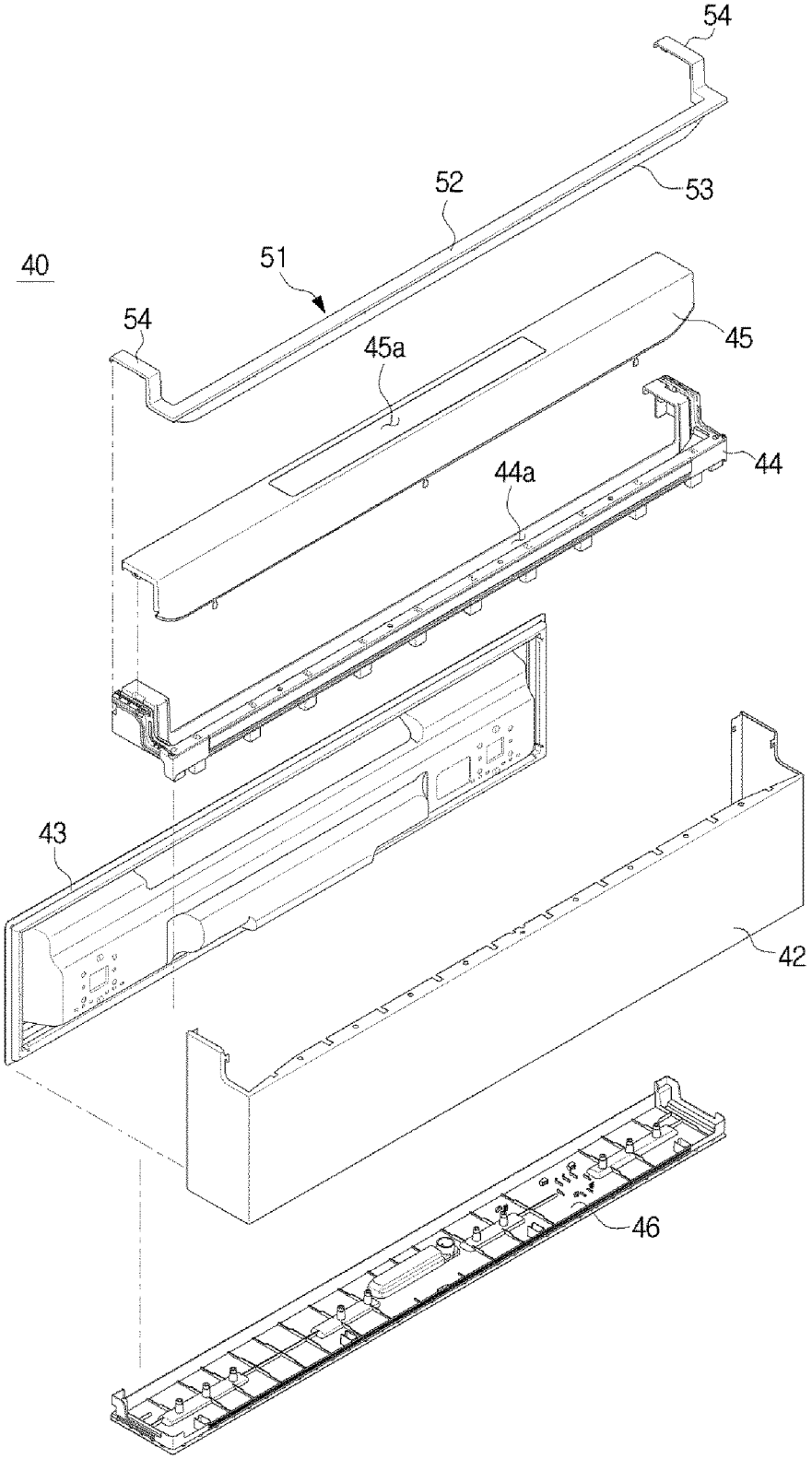
FIG. 9 is an exploded perspective view of the intermediate door of the refrigerator according to one embodiment of the present disclosure.
Figure 10:
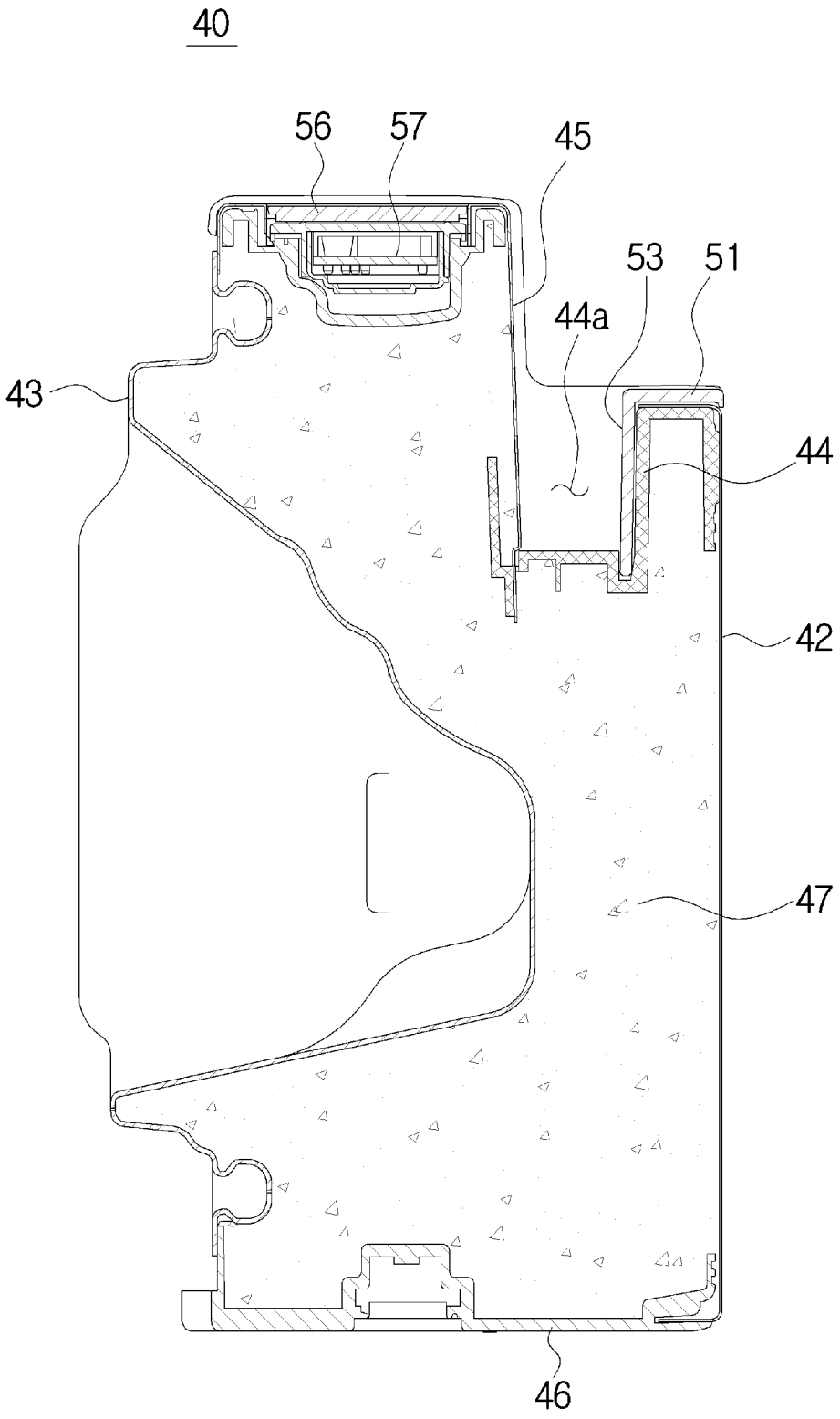
FIG. 10 is a cross-sectional view taken along a line I-I in FIG. 8.
Figure 11:
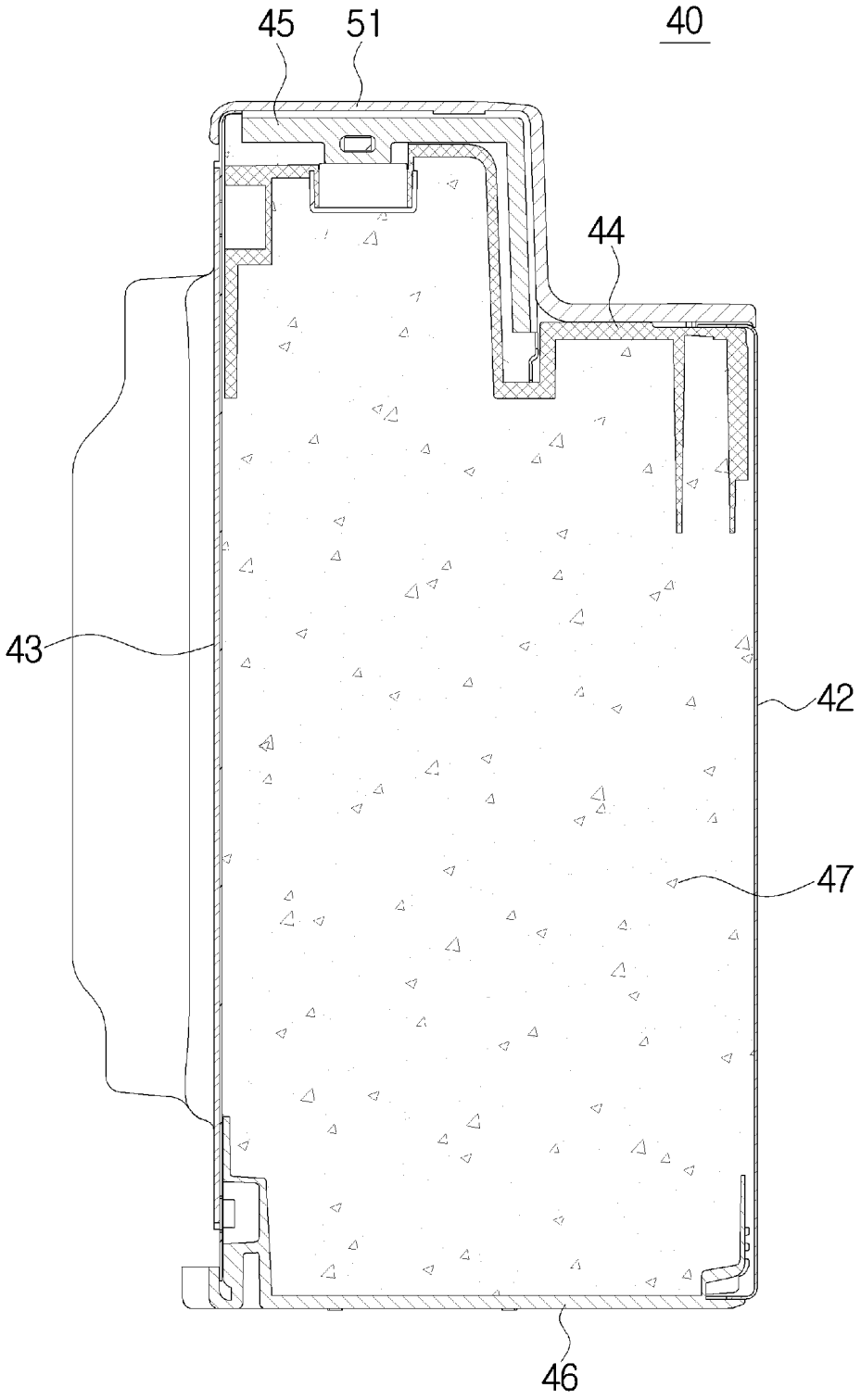
FIG. 11 is a cross-sectional view taken along a line II-II in FIG. 8.
Figure 12:
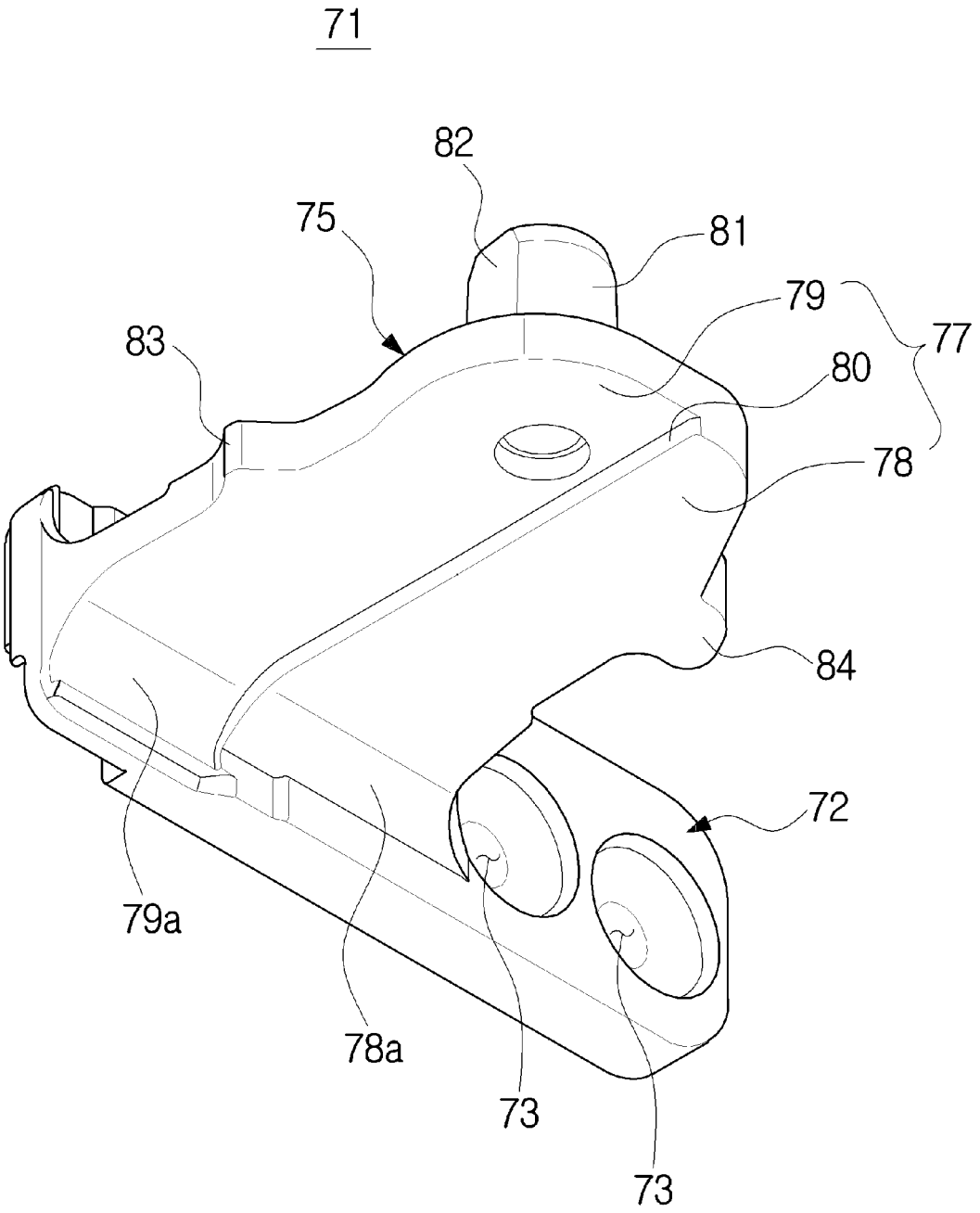
FIG. 12 is a perspective view of a bottom surface of the hinge member of the refrigerator according to one embodiment of the present disclosure.
Figure 13:
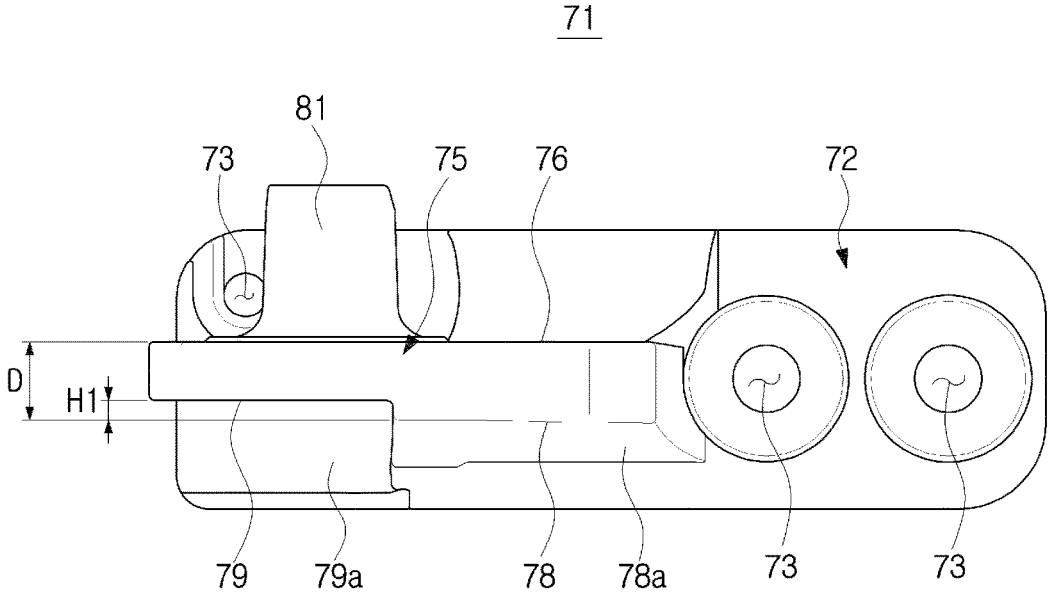
FIG. 13 is a front view of the hinge member of the refrigerator according to one embodiment of the present disclosure.
Figure 14:
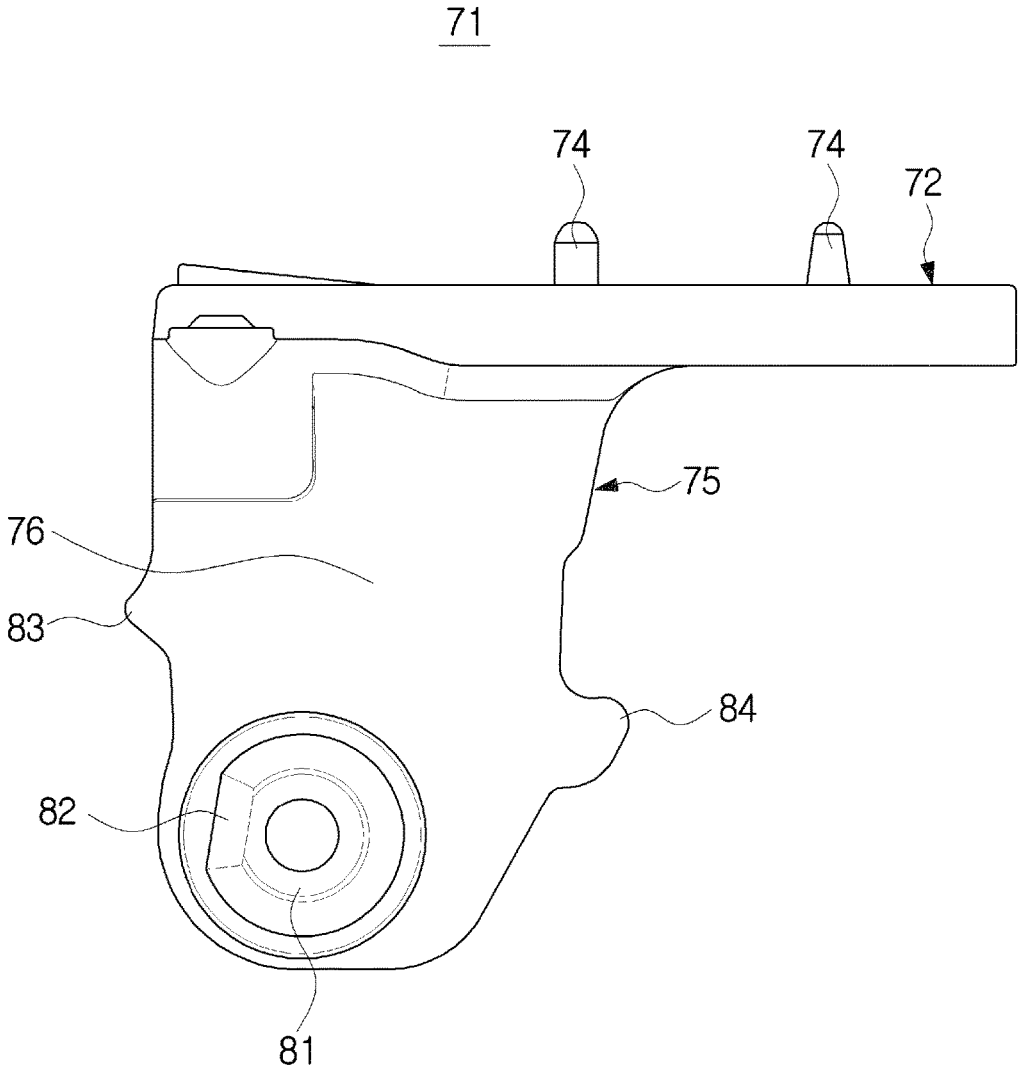
FIG. 14 is a top view of the hinge member of the refrigerator according to one embodiment of the present disclosure.
Figure 15:
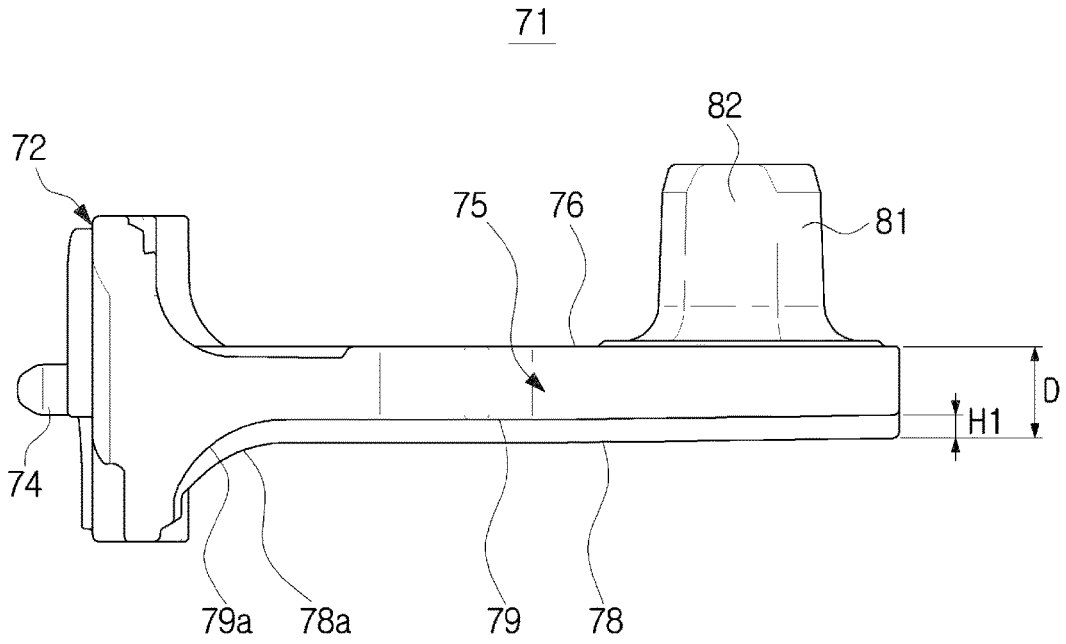
FIG. 15 is a side view of the hinge member of the refrigerator according to one embodiment of the present disclosure.

FIG. 3 is an exploded perspective view illustrating an intermediate hinge assembly of the refrigerator according to one embodiment of the present disclosure. FIG. 4 is an exploded perspective view illustrating a structure in which the intermediate hinge assembly of the refrigerator according to one embodiment of the present disclosure is coupled to a bottom surface of an upper door. FIG. 5 is an exploded perspective view of the upper door of the refrigerator according to one embodiment of the present disclosure. FIG. 6 is a front view illustrating a state in which a hinge member of the refrigerator according to one embodiment of the present disclosure is installed at a main body (the upper door is not shown). FIG. 7 is a side view of a vicinity of the intermediate hinge assembly of the refrigerator according to one embodiment of the present disclosure. FIG. 8 is a perspective view of an intermediate door of the refrigerator according to one embodiment of the present disclosure. FIG. 9 is an exploded perspective view of the intermediate door of the refrigerator according to one embodiment of the present disclosure. FIG. 10 is a cross-sectional view taken along a line I-I in FIG. 8. FIG. 11 is a cross-sectional view taken along a line II-II in FIG. 8. FIG. 12 is a perspective view of a bottom surface of the hinge member of the refrigerator according to one embodiment of the present disclosure. FIG. 13 is a front view of the hinge member of the refrigerator according to one embodiment of the present disclosure. FIG. 14 is a top view of the hinge member of the refrigerator according to one embodiment of the present disclosure. FIG. 15 is a side view of the hinge member of the refrigerator according to one embodiment of the present disclosure.

Referring to FIGS. 3 to 15, a structure of the intermediate hinge assembly 70, the intermediate door 40, and the upper doors 20 and 30 of the present disclosure will be described.

The intermediate hinge assembly 70 supporting the left upper door 20 and the intermediate hinge assembly 70 supporting the right upper door 30 are symmetrical to each other so that only the intermediate hinge assembly 70 supporting the left upper door 20 will be described.

For convenience of description, the intermediate hinge assembly 70 may simply be referred to below as a hinge assembly 70. Further, the upper door 20 and the intermediate door 40 may be referred to as a door 20 and a door 40, respectively.

The hinge assembly 70 may include a hinge member 71 coupled to the main body 10, a hinge bracket 85 coupled to the lower portion of the door 20, a grommet member 95 provided between the hinge member 71 and the hinge bracket 85 to prevent friction between the hinge member 71 and the hinge bracket 85, and an elastic member 90 configured to automatically close the door 20 when the door 20 is closed by a predetermined angle or more.

The hinge member 71 may include a main body coupler 72 provided to be coupled to the main body 10, and a door supporter 75 extending from the main body coupler 72 in a direction intersecting therewith to support the door 20. The main body coupler 72 may be formed substantially parallel to a front surface of the main body 10, and the door supporter 75 may be formed substantially perpendicular to the main body coupler 72.

The main body coupler 72 may be fixed to the front surface of the main body 10 by an engagement member S1, and to this end, at least one engagement hole 73 (See, FIG. 12) may be formed at the main body coupler 72. The engagement member S1 may include various mechanical coupling elements such as screws, nails, rivets, pins, bolts, and the like.

The main body coupler 72 may include a coupling protrusion 74 (See, FIG. 14) protruding toward a rear side so as to adjust a position of the main body coupler 72 while the hinge member 71 is coupled to the front surface of the main body 10. The coupling protrusion 74 may be inserted into a coupling hole (not shown) formed on the front surface of the main body 10. Accordingly, the coupling protrusion 74 is inserted into the coupling hole and then the engagement member S1 is engaged with the engagement hole 73 such that the hinge member 71 may be engaged with the front surface of the main body 10.

The door supporter 75 may include a hinge pin 81 protruding upward to form a rotational axis of the door 20, a stopper interference protrusion 83 provided to restrict a rotational range of the door 20, and a closure interference protrusion 84 provided to interact with the elastic member 90.

The hinge pin 81 may be inserted into the lower portion of the door 20. Specifically, the hinge pin 81 may be inserted into a hollow interior of the grommet member 95, and the grommet member 95 may be inserted into the lower portion of the door 20 by passing through a through-hole 87 of the hinge bracket 85. This is because both the hinge member 71 and the hinge bracket 85 are made of metal materials and thus dust and noise may be generated due to rubbing between the hinge member 71 and the hinge bracket 85 when the door 20 is rotated, so that, in order to prevent the dust and the noise, the grommet member 95 made of a resin material is disposed between the hinge member 71 and the hinge bracket 85.

The grommet member 95 may include a hollow cylindrical portion 96 having a substantially hollow and a cylindrical shape, and a flange 97 extending radially outwardly from a lower portion of the hollow cylindrical portion 96. The hinge pin 81 may be inserted into the hollow of the hollow cylindrical portion 96, and the hollow cylindrical portion 96 may be inserted into the lower portion of the door 20 by passing through the through-hole 87 of the hinge bracket 85. A rotation preventer 82 may be provided at the hinge pin 81, and an interference surface (not shown) corresponding to the rotation preventer 82 may be provided at a hollow inner circumferential surface of the hollow cylindrical portion 96. Consequently, a rotation of the grommet member 95 may be prevented by hooking of the rotation preventer 82 and the interference surface.

The flange 97 may be disposed between a bottom surface of the hinge bracket 85 and an upper surface of the door supporter 75 to prevent the hinge bracket 95 and the door supporter 75 from rubbing against each other.

The stopper interference protrusion 83 may interfere with the stopper protrusion 88 of the hinge bracket 85 when the door 20 is opened by a predetermined angle or more, thereby preventing the door 20 from further rotating. The stopper interference protrusion 83 may protrude toward a side opposite to a central portion of the refrigerator 1.

The closure interference protrusion 84 may interact with the elastic member 90 while the door 20 is opened and closed. The closure interference protrusion 84 may protrude toward the central portion side of the refrigerator 1 as opposed to the stopper interference protrusion 83.

The elastic member 90 may be configured to apply a force to the door 20 in a direction in which the door 20 is closed. The elastic member 90 may include a fixed end 91 fixed to the lower portion of the door 20 and an acting end 93 provided to be movable to interfere with the closure interference protrusion 84, and may be formed in a 'C' shape. The elastic member 90 may be one of leaf springs.

An engagement hole 92 with which an engagement member S3 (See, FIG. 3) is engaged may be provided at the fixed end 91, so that the fixed end 91 may be fixed to the lower portion of the door 20 by the engagement member S3.

While the door 20 is opened and closed, the acting end 93 is moved by interfering with the closure interference protrusion 84, and during the movement of the acting end 93, an elastic force may be accumulated at the elastic member 90 while a shape of the elastic member 90 deformed.

The elastic member 90 may be configured such that no elastic force is generated in a state in which the door 20 is closed. The elastic member 90 may be provided such that the door 20 is gradually opened, the closure interference protrusion 84 and the acting end 93 interfere with each other, and an elastic force is gradually accumulated at the elastic member 90, so that the elastic force is maximized when an angle between the door 20 and the main body 10 reaches a predetermined angle. The elastic member 90 may be provided such that, when the door 20 is opened further than the predetermined angle, interference between the closure interference protrusion 84 and the acting end 93 is released.

Therefore, until the angle between the door 20 and the main body 10 reaches the predetermined angle while the door 20 is opened, the elastic member 90 may apply an elastic force to the door 20 in a direction in which the door 20 is closed. The angle between the door 20 and the main body 10 reaches the predetermined angle while the door 20 is closed, and from then on, the elastic member 90 may apply an elastic force to the door 20 in a direction in which the door 20 is closed. That is, the angle between the door 20 and the main body 10 reaches the predetermined angle while the door 20 is closed, and from then on, the door 20 may be automatically closed by the elastic force of the elastic member 90.

The door supporter 75 may include an upper surface 76 and a bottom surface 77. The above-described hinge pin 81 may protrude from the upper surface 76 of the door supporter 75. The upper surface 76 of the door supporter 75 may be formed to be substantially flat so as to allow an entire area of the upper surface 76 of the door supporter 75 to have the same height.

Unlike the upper surface 76, the bottom surface 77 of the door supporter 75 may have a plurality of areas having different heights, rather than having the same height in an entire area of the bottom surface 77. That is, the bottom surface 77 of the door supporter 75 may include a base surface 78, and a recessed surface 79 formed to be recessed from the base surface 78 to be disposed at a higher height than the base surface 78.

The reason why the bottom surface 77 of the door supporter 75 includes the base surface 78 and the recessed surface 79 which are disposed at different heights is that a height of an upper surface of the door 40 disposed below the hinge member 71 is not constant and there is a protruding portion. That is, a height difference of the upper surface of the door 40 is compensated for to keep a constant gap between the bottom surface 77 of the door supporter 75 and the upper surface of the door 40.

The protruding portion of the door 40 may be a door trim 51. A structure of the door 40 will be described below.

The door 40 may include a door body 41, and the door trim 51 coupled to the door body 41.

The door body 41 may include a front surface plate 42; a rear surface plate 43; a lower cap 46 coupled to a lower portion of each of the front surface plate 42 and the rear surface plate 43; an upper cap 44 coupled to an upper portion of each of the front surface plate 42 and the rear surface plate 43 and at which a handle recess 44*a* (See, FIG. 10) is formed; an upper plate 45 coupled to the upper portion of each of the front surface plate 42 and the rear surface plate 43 and at which a display 56 configured to display operation information of the refrigerator 1 is installed; and an insulation 47 provided inside the door body 41.

The front surface plate 42, the rear surface plate 43, and the upper plate 45 may be formed of metal materials, and the lower cap 46 and the upper cap 44 may be formed of resin materials. A user may open the door 40 by putting his or her hand into the handle recess 44*a* of the upper cap 44 to pull the door 40. A display installation recess 45*a* (See, FIG. 9) at which the display 56 is installable may be formed at the upper plate 45. A display circuit 57 (See, FIG. 10) capable of controlling the display 56 may be disposed below the upper plate 45.

The door trim 51 may be coupled to the door body 41 to improve the exterior appearance of the door 40, alleviate vibration transmitted to the user when the door 40 is opened and closed, and strengthen a coupling force between the respective components constituting the door 40. The door trim 51 may be coupled to an upper side of each of the upper cap 44 and the upper plate 45.

The door trim 51 may extend from a left end to a right end of the door 40. The door trim 51 may include a door trim body 52 extending in a left-right direction, and a door trim wing 54 extending in a rear direction from both ends of left and right sides of the door trim body 52. The door trim body 52 and the door trim wing 54 may be integrally formed.

The door trim 51 may include a gripper 53 which is provided to be held by a hand to open the door 40. The gripper 53 may extend downward from the door trim body 52 to be inserted into the handle recess 44*a* of the upper cap 44.

Since the door trim 51 is coupled to an upper side of the upper plate 45, an upper surface 51*a* of the door trim 51 may protrude above an upper surface 41*a* of the door body 41 (See, FIG. 6). A width W2 of the door trim 51 in the left-right direction may be narrower than an entire area W1 of the bottom surface of the door supporter 75 of the hinge member 71 (See, FIG. 6).

Accordingly, the recessed surface 79 of the door supporter 75 may be recessed from the base surface 78 of the door supporter 75 to compensate for a height difference H2 between the upper surface 51*a* of the door trim 51 and the upper surface 41*a* of the door body 41.

A height difference H1 between the base surface 78 and the recessed surface 79 may be equal to the height difference H2 between the upper surface 51*a* of the door trim 51 and the upper surface 41*a* of the door body 41.

The height difference H1 between the base surface 78 and the recessed surface 79 is preferably less than half a thickness D of the door supporter 75, which is a thickness between the upper surface 76 and the base surface 78 so as to sufficiently maintain rigidity of the door supporter 75.

Each of the base surface 78 and the recessed surface 79 may be formed to be flat and horizontal with respect to the ground. Since a position of the door trim 51 is disposed at a side opposite to the central portion of the refrigerator 1, the recessed surface 79 may also be disposed further than the base surface 78 at the side opposite to the central portion of the refrigerator 1 by corresponding to the position of the door trim 51.

The base surface 78 and the recessed surface 79 may be connected by a connecting surface 80. The connecting surface 80 may be substantially vertically formed. The connecting surface 80 may extend in a direction from a front side to a rear side of the refrigerator 1.

In order to strengthen the rigidity of the door supporter 75 and the main body coupler 72, a rounded portion 78*a* and a rounded portion 79*a* may be formed at rear sides of the base surface 78 and the recessed surface 79, respectively.

The main body coupler 72 and the door supporter 75 may be made of metal materials and may be integrally formed by die casting or the like.

As described above, even though a portion of the upper surface of the door 40 disposed below the hinge member 71 protrudes, since the bottom surface 77 of the door supporter 75 of the hinge member 71 includes the recessed surface 79 corresponding to the protruding portion of the door 40, the rigidity of the hinge member 71 may be sufficiently maintained, and also the gap between the bottom surface of the hinge member 71 and the upper surface of the door 40 may be kept constant. Consequently, phenomena in which foreign materials are trapped between the hinge member 71 and the door 40, and the hinge member and the door interfere with each other due to sagging of the door can be prevented such that reliability of opening and closing operations of the door can be improved and the overall exterior appearance of the refrigerator 1 can be improved.

A structure of the upper door 20 will be described below.

As described above, the hinge assembly 70 is coupled to the lower portion of the upper door 20 and is disposed between the upper door 20 and the intermediate door 40. Specifically, as shown in FIG. 5, the upper door 20 is formed by assembling a front surface plate 22, a rear surface plate 23, an upper cap (not shown), and a lower cap 24, and an insulation is filled inside upper door 20. The hinge assembly 70 may be installed at the lower cap 24.

The lower cap 24 may include a bottom 25 configured to form a bottom surface of the door 20, and a hinge installation portion 26 at which the hinge assembly 70 is installed.

The hinge installation portion 26 may be formed to be recessed from the bottom 25 so as to prevent exposure of at least a portion of the hinge assembly 70 when the refrigerator 1 is viewed from the front surface thereof. That is, when the refrigerator 1 is viewed from the front thereof, at least a portion of the hinge assembly 70 installed at the hinge installation portion 26 may not be exposed by being covered by a portion 25*a* of a bottom formed at a front side of the hinge installation portion 26.

As described above, since at least a portion of the hinge assembly 70 is not exposed, an aesthetic appearance of the refrigerator 1 can be improved, and an overall height of the refrigerator 1 can be relatively lowered or a space of the storage compartment can be further secured.

The hinge bracket 85 and the elastic member 90 which are described above may be installed at the hinge installation portion 26. To this end, the hinge installation portion 26 may include a base stepped portion 27*a* recessed from the bottom 25, a hinge bracket installation portion 27*b* further recessed from the base stepped portion 27*a* to allow the hinge bracket 85 to be installed, and an elastic member installation portion 27*c* further recessed from the base stepped portion 27*a* to allow the elastic member 90 to be installed.

A hinge hole 28 into which the hinge pin 81 of the hinge member 71 is inserted may be formed at the hinge installation portion 26.

In accordance with the present disclosure, when a height of the upper surface of the door disposed below the intermediate hinge is not constant and there is a protruding portion, strength of the intermediate hinge can be sufficiently maintained, and also the gap between the bottom surface of the intermediate hinge and the upper surface of the door can be constant over the entire area of the bottom surface of the intermediate hinge. Consequently, the reliability and stability of the opening and closing operations of the door can be improved, and a design of the exterior appearance of the refrigerator can be improved.

In accordance with the present disclosure, when the refrigerator is viewed from the front thereof, exposure of the hinge assembly is minimized such that the design of the exterior appearance of the refrigerator can be improved.

Specific embodiments have been shown and described as above, but the scope of the present disclosure is not limited to these specific embodiments Various changeable and modifiable embodiments can be devised from those skilled in the art without departing from the gist of a technical spirit that is defined by the appended claims.

What is claimed is:

1. A refrigerator comprising:

a main body having a storage compartment;

a first door rotatably provided to open and close the storage compartment;

a hinge member coupled to a lower portion of the first door and configured to support the first door; and a second door provided below the hinge member, wherein the second door includes a door body and a door trim protruding from an upper surface of the door body toward the hinge member, the hinge member includes a main body coupler provided to be coupled to the main body and a door supporter extending from the main body coupler in a front-rear direction, and a bottom surface of the door supporter includes a base surface corresponding to the door body and a recessed surface recessed from the base surface and corresponding to the door trim to compensate for a height difference between an upper surface of the door trim and the upper surface of the door body to keep a constant gap between the recessed surface and the upper surface of the door trim and between the base surface and the upper surface of the door body.

2. The refrigerator of claim 1, wherein the bottom surface of the door supporter includes a connecting surface configured to connect the base surface to the recessed surface and formed in a vertical direction.

3. The refrigerator of claim 2, wherein the connecting surface extends in a front-rear direction of the refrigerator.

4. The refrigerator of claim 1, wherein a height difference between the base surface and the recessed surface is equal to the height difference between the upper surface of the door trim and the upper surface of the door body.

5. The refrigerator of claim 1, wherein a height difference between the base surface and the recessed surface is less than half a thickness of the door supporter.

6. The refrigerator of claim 1, wherein the recessed surface is disposed further than the base surface at a side opposite to a central portion of the refrigerator.

7. The refrigerator of claim 1, wherein each of the base surface and the recessed surface is formed to be flat.

8. The refrigerator of claim 1, wherein each of the base surface and the recessed surface is formed to be parallel to an upper surface of the door supporter.

9. The refrigerator of claim 1, wherein the main body coupler and the door supporter are integrally formed of metal materials.

10. The refrigerator of claim 1, wherein:

the door body includes an upper cap having a handle recess, and the door trim is coupled to an upper portion of the upper cap.

11. The refrigerator of claim 10, wherein:

the door trim includes a gripper configured to allow a user to hold and open the second door, and the gripper is inserted into the handle recess.

12. The refrigerator of claim 1, wherein the door trim extends from a left end to a right end of the second door.

13. The refrigerator of claim 1, wherein:

the door body includes an upper plate having a display installation recess therein at which a display is installed, and the door trim is coupled to an upper portion of the upper plate.

14. A refrigerator comprising:

a main body having a storage compartment;

a door rotatably provided to open and close the storage compartment; and a hinge assembly coupled to a lower portion of the door and configured to support the door to allow the door to be rotatable, the hinge assembly including an elastic member provided to apply a force to the door in a direction in which the door is closed, wherein the door includes a lower cap, the lower cap includes a bottom portion configured to form a bottom surface of the door, and a hinge installation portion provided to allow the hinge assembly to be coupled, and the hinge installation portion is formed to be recessed from the bottom portion so as to prevent exposure of at least a portion of the hinge assembly and the hinge installation portion includes an elastic member installation portion formed to be recessed from the base stepped portion to allow the elastic member to be installed.

15. The refrigerator of claim 14, wherein:

the hinge assembly includes a hinge member having a hinge pin configured to form a rotational axis of the door and coupled to the main body, and a hinge bracket having a through-hole through which the hinge pin passes and coupled to a lower portion of the door, and the hinge installation portion includes a base stepped portion, and a hinge bracket installation portion formed to be recessed from the base stepped portion to allow the hinge bracket to be installed.

16. The refrigerator of claim 15, wherein:

each of the hinge member and the hinge bracket is formed of a metal material, and the hinge assembly includes a grommet member made of a resin material and provided between the hinge member and the hinge bracket to prevent rubbing therebetween.

17. The refrigerator of claim 14, wherein at least a portion of the hinge assembly is not exposed when the refrigerator is viewed from the front thereof.

18. The refrigerator of claim 17, wherein at least a portion of the bottom portion is disposed at a front side of the hinge installation portion.

* * * * *